United States Patent [19]

Schön

[11] 4,170,195

[45] Oct. 9, 1979

[54] DEVELOPING APPARATUS FOR DEVELOPING LATENT ELECTROSTATIC IMAGES

[75] Inventor: Klaus-Peter Schön, Wiesbaden, Fed. Rep. of Germany

[73] Assignee: Hoechst Aktiengesellschaft, Fed. Rep. of Germany

[21] Appl. No.: 863,448

[22] Filed: Dec. 22, 1977

[30] Foreign Application Priority Data

Dec. 24, 1976 [DE] Fed. Rep. of Germany ..... 2658792

[51] Int. Cl.[2] ..... G03G 13/09

[52] U.S. Cl. ..... 118/658; 118/653

[58] Field of Search ..... 118/653, 654, 657, 658

[56] References Cited

U.S. PATENT DOCUMENTS

| | | | |
|---|---|---|---|
| 3,393,663 | 7/1968 | Donalies | 118/654 X |
| 3,547,077 | 12/1970 | Sage | 118/657 |
| 3,697,050 | 10/1972 | Stanley | 118/658 |
| 3,707,947 | 1/1973 | Reichart | 118/658 |
| 3,881,446 | 5/1975 | Kurita et al. | 118/657 |
| 3,943,887 | 3/1976 | Smith | 118/658 X |
| 3,982,498 | 9/1976 | Wilcox | 18/658 |
| 4,044,719 | 8/1977 | Ohmori | 118/658 |

*Primary Examiner*—Mervin Stein

*Attorney, Agent, or Firm*—James E. Bryan

[57] ABSTRACT

This invention relates to an improvement in a developing apparatus for developing latent electrostatic images, comprising a hopper for a developer, two magnetic brush means rotatably supported one above the other between the side walls of the hopper, and strippers for removing the developer from the magnetic brush means, the improvement comprising a plurality of hinged compartment means in a collecting space for the developer in the hopper, and means for oscillating said compartment means in the longitudinal direction.

8 Claims, 4 Drawing Figures

Figure 1:
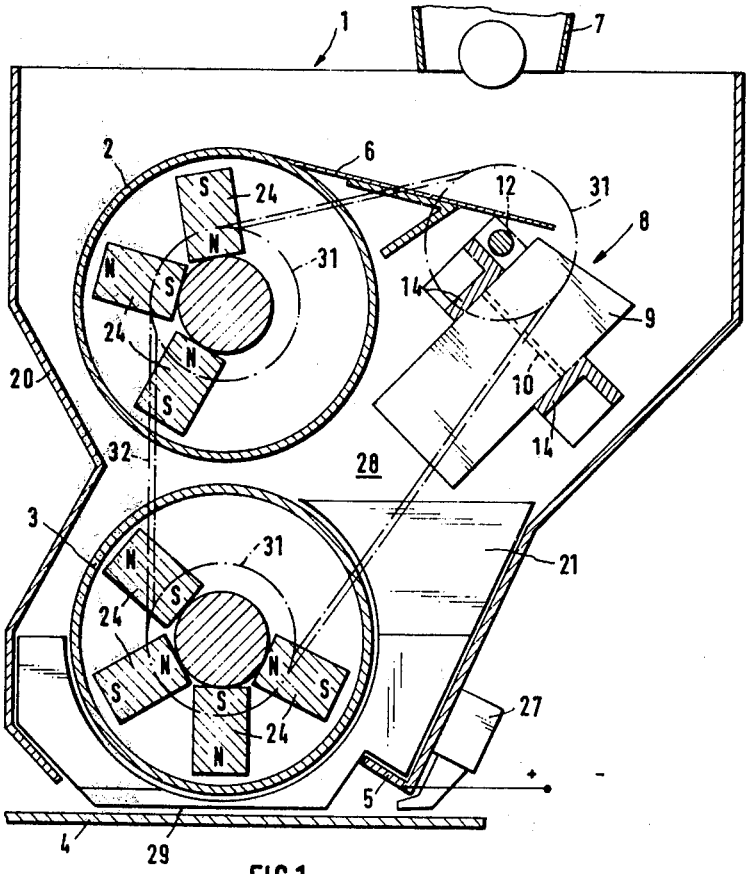

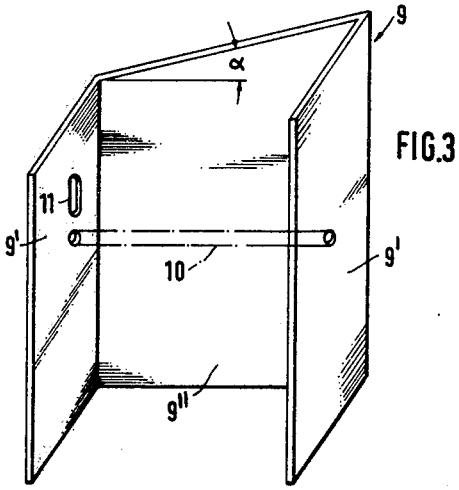
FIG.3
FIG.4
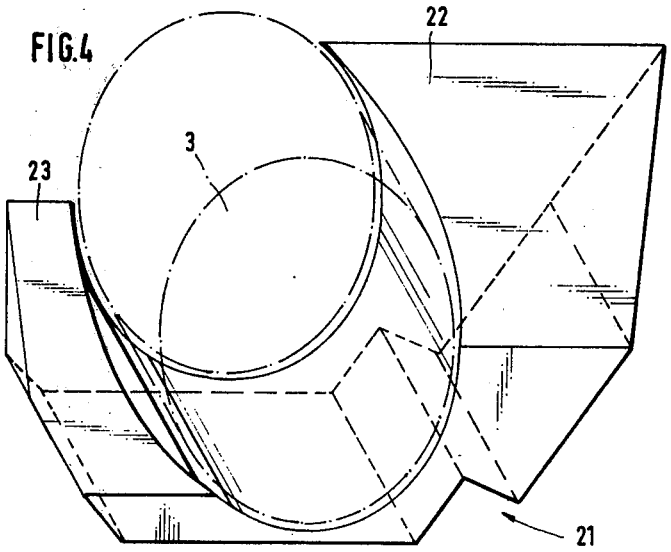

DEVELOPING APPARATUS FOR DEVELOPING LATENT ELECTROSTATIC IMAGES

This invention relates to a developing apparatus for developing latent electrostatic images, comprising a hopper for a developer, two magnetic brushes rotatably supported between the side walls of the hopper, as well as strippers for removing the developer from the magnetic brushes.

A number of developing devices with magnetic brushes are already known which serve the purpose of developing an electrostatic charge image on an image carrier. The image carrier may be a printing plate or a surface coated with a photoconductive substance, e.g. a photoconductor on a drum.

The above-described developing apparatus for an electrophotographic copier is known from German Offenlegungsschrift No. 2,166,667. The apparatus is equipped with two recirculating screws, which are positioned on either side of a partition wall and which can be driven so as to rotate in opposite directions for recirculation mixing of the developer. Similar to blades or paddles moving in the developer sump for transverse mixing, these screws will soon produce fatigue of the developer and thus a change of its triboelectric properties. In this known apparatus the image carrier is developed while the image carrier drum is approximately in a three or four o'clock position.

In the developing apparatus with magnetic brushes proposed in German Offenlegungsschrift No. 2,225,287, a stripping plate arranged close to the magnetic brush displaces the developer stripped off of the shell surface of the magnetic brush in the axial direction of the rotational movement of the magnetic brush. For this purpose, the body of the stripping plate is provided with upwardly sloping sections, and with inclined blade sections branching off from these upwardly sloping sections. By means of the blade sections the developer is also conveyed in the direction of the rotational axis of the magnetic brush. The image carrier to be developed passes the magnetic brush approximately in a one to two o'clock position. Mixing in the developer sump does not take place.

Normally, only one magnetic roll is used in developing systems for printing plates. The printing plates are either moved over the magnetic roll in a horizontal position or they are led past the magnetic roll in a vertical position while the toner is applied. These systems complicate processing of the printing plate in a processing line, because following exposure the printing plate must be turned or placed upright. As a further disadvantage, a developer sump forms below or laterally of the magnetic roll and is insufficiently mixed due to the narrowness of the developing apparatus. As a consequence, the toner concentration in the developer may vary.

It is the object of the present invention to provide a developing apparatus for developing latent electrostatic images on an image carrier, which developing apparatus allows through mixing of the developer without substantially changing its triboelectric properties and while maintaining a stable toner concentration in the developer, in order to ensure uniform developing. In connection with the above mentioned object endeavours are also made to reduce the developing time by avoiding a change of the position of the image carrier, before it is led past the developing apparatus.

The object is achieved by means of a set of compartments oscillating in the longitudinal direction and comprising a number of hinged compartments which are positioned in the collecting space for the developer within the hopper.

The invention produces the advantages that the oscillating set of compartments effects a constant transverse mixing in the collecting space for the developer just before the developer is discharged from the developing apparatus; formation of developer lumps and breaking of the toner or carrier particles of the developer are avoided, which may occur when mixing is effected by screws; it is possible to develop image carriers which are led past underneath the developing apparatus in the horizontal position; and the developer stripped off of the lower magnetic roll is already fanned out during transfer to the upper magnetic roll prior to being fed into the set of compartments, thus preventing non-uniform local toner concentrations in the developer.

Figure 2:
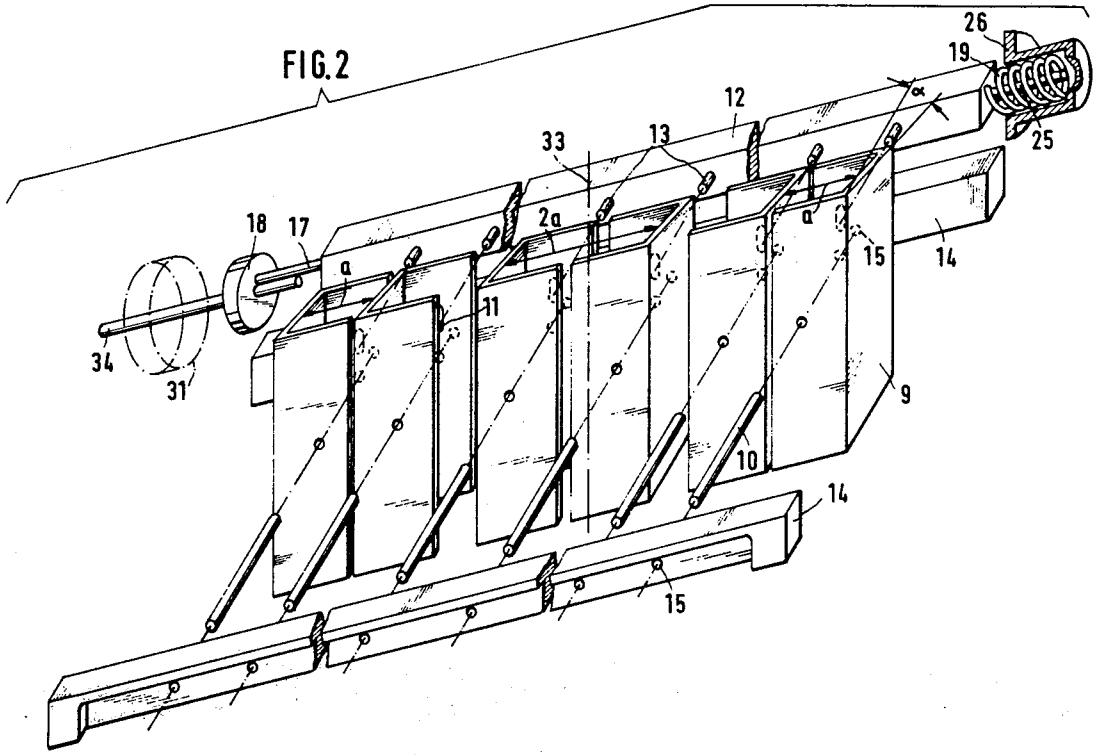

The invention will be further illustrated by reference to the accompanying drawings in which:

FIG. 1 shows a longitudinal section of a developing apparatus according to the invention, FIG. 2 is an exploded view of the set of compartments as well as of the support for the driving rod of the set of compartments, FIG. 3 is a perspective view of an individual compartment, and FIG. 4 is a diagrammatic perspective view of a stripper of the developing apparatus.

FIG. 1 is a diagrammatic sectional view of a developing apparatus 1 showing a hopper 20 containing a lower magnetic brush 3 and an upper magnetic brush 2 arranged one above the other. The magnetic brushes 2 and 3 comprise cylindrical hollow rolls having radially positioned rod magnets 24 inside. Adjacent magnets 24 have different polarities at the poles facing the shells of the rolls. The two magnetic brushes 2 and 3 rotate in the same direction, and, by its magnetic field which is directed vertically downwards, the lower magnetic brush 3 develops a latent electrostatic image on an image carrier 4, which is passed in a horizontal position underneath a discharge opening 29 at the bottom of the developing apparatus 1.

The upper magnetic brush 2 serves to transport the developer which is conveyed upwardly by the lower magnetic brush 3.

On the right of the two magnetic brushes 2 and 3 a collecting space 28 for the developer is shown in FIG. 1. A set of compartments 8 is positioned in the collecting space 28 and comprises a number of hinged compartments 9. A stripper plate 6 which tangentially contacts the upper magnetic brush 2 close to its highest point gently slopes down towards the set of compartments 8. The developer removed from the surface of the upper magnetic brush 2 by the stripper plate 6 is fed into the set of compartments 8 for toner addition and transverse mixing. Above the stripper plate 6 a "topping-up" device 7 is mounted, from which predetermined quantities of toner are added to the developer. The developer which is thoroughly mixed in the set of compartments 8 is discharged at the bottom of the compartments and is collected in a sump. At the bottom of the sump a doctor knife 5 is positioned in an inclined position relative to the surface of the lower magnetic brush 3 and at a small distance from the magnetic brush, so that the layer of developer on the shell surface of the applying lower magnetic brush 3 is limited to a particular thickness. As soon as the developer has emerged from the gap between the lower magnetic brush 3 and the doctor knife 5 it is ready for another developing procedure. A suction device 27 is provided adjacent the developing apparatus 1 or connected thereto. This suction device serves to draw off any excess developer which is, e.g., left on the image carrier 4 or which cannot be retained by the magnetic field of the lower magnetic brush 3.

As shown in FIG. 2, the set of compartments 8 is composed of a support frame with two longitudinal girders 14 interconnected by continuous shafts 10 extending transversely to the longitudinal girders. The compartments 9 are mounted on the shafts 10 and they are caused to oscillate by a driving rod 12 which is arranged above one of the girders 14 and is provided with the driving pins 13 engaging in the slots 11 in one of the side walls 9' of the compartments 9. The compartments 9 have a U-shaped profile formed by a main wall 9'' and the side walls 9'. As shown in FIG. 3, the bottom edges of the main wall 9'' and the side walls 9' are horizontal, whereas their top edges are inclined and the side wall 9' on the right in FIG. 3 is longer than the side wall on the left. The angle of incline $\alpha$ of the top edge of the main wall 9'' relative to the horizontal is between 10° and 30°.

The shafts 10 penetrate the side walls 9' of the compartments 9 above their centers and are supported in the holes 15 in the longitudinal girders 14. The slots 11, shown in the left side wall 9' in FIG. 3, are positioned above the shafts 10. Because the compartments 9 are eccentrically supported on the shafts 10 in the upper half of the side walls 9', they will invariably execute an oscillating movement when the driving rod 12 is moved to an fro, thus ensuring uniform mixing of the developer. In order to produce oscillation of the set of compartments 8, the driving rod 12 is moved forward and backward. For this purpose, one end journal 25 is encompassed by a spring 19, as can be seen from FIG. 2. The spring 19 elastically supports the end journal 25 in a support flange 26 and pushes the driving rod 12 towards the end journal 17 at the opposite end. The end journal 17 contacts a rotating driven cam 18 which, by its rotation, produces an oscillating movement of the driving rod 12. According to this movement of the driving rod 12, the compartments 9 start to swing and swivel on the shafts 10. The compartments 9 are arranged mirror-symmetrically relative to the center line 33 of the set of compartments 8 in such a manner that the two compartments on either side of the center line face each other with the open sides of the U-profiles.

The distance between the main walls 9'' of the two compartments 9 adjacent the center line 33 is, e.g., 2*a* and is thus twice the distance a between the main walls 9'' of two neighboring compartments positioned farther away from the center line 33. Due to the mirror-symmetrical arrangement of the compartments 9 the developer can neither accumulate nor form lumps, in particular in the area of the center line 33 of the set of compartments.

The stripper 21 in FIG. 4 has two bevelled sections 22 and 23; one of these bevelled sections 23 start at a lower level than the other 22. On stripper 21 each partly encompasses the lower magnetic brush 3 close to either end face and limits the flow of developer approximately to the width of the image carrier 4. The strippers 21 deviate the dropping developer in such a manner that the magnetic flux lines, which take an undefined course at the extremities of the lower magnetic brush 3 remain ineffective. Thus, any objectionable expansion of developer along such magnetic flux lines is restrained. The first bevelled section 22 prevents an accumulation of the developer, whereas the second bevelled section 23, which starts at a lower level, allows an immediate fanning out of the developer when the magnetic brush 3 turns upwards. As a result, transfer to the upper magnetic brush 2 and feeding of the developer into the set of compartments 8 as well as transverse mixing of the developer are facilitated and thus variations in toner concentration do not occur.

The shafts of the magnetic brushes 2 and 3 are equipped with driving wheels 31, e.g. gear wheels, positioned adjacent one end of each shaft, as indicated by chain-dotted lines in FIG. 1. Another driving wheel 31 and the cam 18 are mounted on a shaft 34, approximately on a level with the driving rod 12. An endless driving element, e.g. a driving chain, a toothed belt or similar means, is guided over the driving wheels 31. The driving element 32 is tightened by a tightener wheel, not shown in the drawings. A motor, also not shown, drives the shaft 34 or one of the two shafts of the magnetic brushes 2 and 3.

The doctor knife 5 is either on a positive or on a negative potential, as indicated in FIG. 1.

It will be obvious to those skilled in the art that many modifications may be made within the scope of the present invention without departing from the spirit thereof, and the invention includes all such modifications.

What is claimed is:

1. In a developing apparatus for developing latent electrostatic images, comprising a hopper for a developer, two magnetic brush means rotatably supported between the side walls of the hopper, and strippers for removing the developer from the magnetic brush means, the improvement comprising a plurality of hinged compartment means in a collecting space for the developer in the hopper, said plurality of compartment means including a carrier frame with two longitudinal girders interconnected by continuous transverse shafts on which the compartment means are mounted, and means for oscillating said compartment means in the longitudinal direction.

2. A developing apparatus in accordance with claim 1, in which the compartment means have a U-shaped profile formed by a main wall and side walls with horizontal bottom edges and inclined top edges, and the shafts penetrate the side walls above their centers.

3. A developing apparatus in accordance with claim 2, in which the bevel at the top of the main wall and the side walls forms an angle between 10° and 30° relative to the horizontal.

4. A developing apparatus in accordance with claim 1, including a driving rod mounted above one of the longitudinal girders, said driving rod having end journals and being provided with driving pins engaging in slots in one of the side walls of the compartment means.

5. A developing apparatus in accordance with claim 4, in which the slots are positioned above the shafts.

6. A developing apparatus in accordance with claim 5, in which one of the end journals of the driving rod is encompassed by a spring elastically supporting the end journal in a support flange and the second end journal abuts a rotatable driven cam.

7. A developing apparatus in accordance with claim 2, in which the compartment means are positioned mirror-symmetrically relative to the center line of the plurality of compartment means in such a manner that two compartment means on the right and on the left of the center line face each other with the open sides of the U-profiles.

8. A developing apparatus in accordance with claim 7, in which the distance between the main walls of the two compartment means on either side of the center line is twice the distance between the main walls of two neighboring compartments which are farther away from the center line.

* * * * *

UNITED STATES PATENT OFFICE

CERTIFICATE OF CORRECTION

Patent No. 4,170,195 Dated October 9, 1979

Inventor(s) Klaus-Peter Schön

It is certified that error appears in the above-identified patent and that said Letters Patent are hereby corrected as shown below:

Column 1, line 61, "through" should read - - - thorough - - -;

Column 3, line 61, "start" should read - - - starts - - -; line 62, "On" should read - - - One - - -.

Column 4, line 65 (line 2 of claim 6), "5" should read - - - 4 - - -.

Signed and Sealed this

*Twenty-second* Day of *January 1980*

[SEAL]

*Attest:*

SIDNEY A. DIAMOND

*Attesting Officer*

*Commissioner of Patents and Trademarks*